United States Patent [19]

Weirich

[11] 4,068,893

[45] Jan. 17, 1978

[54] APPARATUS FOR CONTROLLING WATER SPRAYING OPERATIONS IN MINERAL MINES

[75] Inventor: Walter Weirich, Dortmund, Germany

[73] Assignee: Gewerkschaft Eisenhutte Westfalia, Lunen, Germany

[21] Appl. No.: 737,332

[22] Filed: Nov. 1, 1976

[30] Foreign Application Priority Data

Nov. 7, 1975 Germany ..... 2550049

[51] Int. Cl.[2] ..... E21C 35/22

[52] U.S. Cl. ..... 299/43; 299/34; 299/17; 299/12

[58] Field of Search ..... 299/1, 17, 34, 43, 12

[56] References Cited

U.S. PATENT DOCUMENTS 3,826,535 7/1974 Fujimori et al. ..... 299/1

3,853,354 12/1974 Weirich et al. ..... 299/17

FOREIGN PATENT DOCUMENTS 965,233 7/1964 United Kingdom ..... 299/17

*Primary Examiner*—Ernest R. Purser

*Attorney, Agent, or Firm*—Thompson, Birch, Gauthier & Samuels

[57] ABSTRACT

A mineral mining installation has a conveyor along which a winning machine such as a plough, is guided for movement back and forth along a mineral face. A series of water-spray nozzles are distributed along the working and is divided in the operational sense into different groups. Each of these groups is controlled by a valve which allows water to pass through non-return valves to one or two adjacent groups of nozzles. The control valves are in turn operated by further valves disposed remote from the actual working zone and these further valves are operated by local means separate and remote from the machine and providing signals and an indication, dependent on the distance moved by the machine and hence its position as it progresses along the face.

9 Claims, 1 Drawing Figure

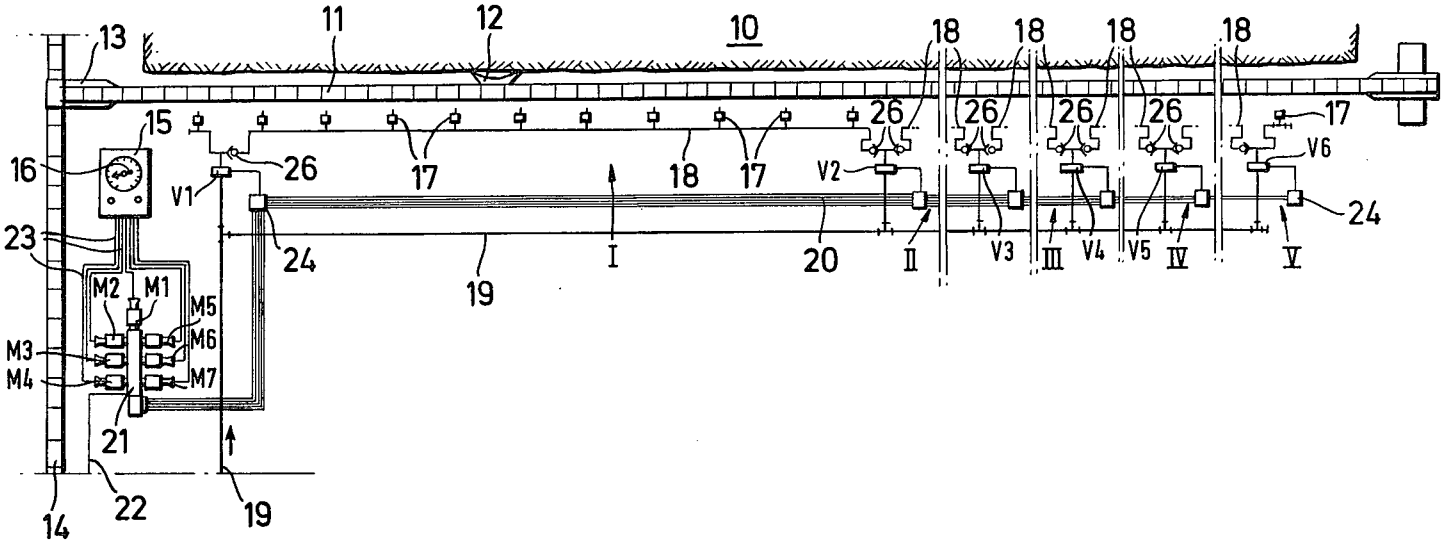
10
11
12
13
14
15
16
17
18
19
20
21
22
23
24
26
V1
V2
V3
V4
V5
V6
M1
M2
M3
M4
M5
M6
M7
I
II
III
IV
V

APPARATUS FOR CONTROLLING WATER SPRAYING OPERATIONS IN MINERAL MINES

BACKGROUND TO THE INVENTION

The present invention relates to mineral mining installations which employ water spray nozzles and more particularly to apparatus for controlling the operation of such nozzles.

It is well known to utilize water spraying nozzles in mineral mines which primarily serve to suppress dust. Usually the nozzles are directed to spray water towards the mineral, e.g. coal, face and the nozzles are selectively operated by the movement of a mineral mining machine, e.g. coal plough, in such a way that only the nozzles in the immediate vicinity of the machine during its travel are actually operated. For such a purpose a magnetic device has been provided on the machine to actuate magnetically-sensitive control valves associated with the nozzles. However, in practice apparatus of this kind is apt to be unreliable and the magnetic device does not always cause the valves to operate at the same distance. In any event it is difficult to construct the apparatus with the necessary precision and in the harsh working conditions encountered in a mine working the apparatus is prone to damage and breakdown. It is also known to provide each control valve with a mechanically operated lever which is moved directly by the impact of the machine as the latter progresses along the appropriate section of the working. Again although such apparatus can be more robust it is also prone to damage and in any event suffers a high degree of wear. Another disadvantage of this mechanical apparatus is that each control valve can usually only adopt its open position permitting water spraying from its associated nozzles when the lever is actually in contact with the machine. This period is not really long enough to efficiently promote dust suppression and to overcome this problem retardation means which inhibits the closure of the valve until a pre-determined time has elapsed after the passage of the machine has been provided. This measure has not been wholly successful however and considerably increases the cost and complexity of the apparatus.

With regard to the foregoing a general object of the present invention is to provide an improved form of control apparatus.

SUMMARY OF THE INVENTION

According to the present invention there is provided an apparatus for controlling the operation of water-spray nozzles in a mineral mining installation which employs a mineral winning machine moved along a mineral face; said apparatus comprising means separate from the machine and operated in accordance with the position of the machine as it travels along the face and a plurality of control valves adapted to be actuated remotely by said means to cause selected spray nozzles to operate sequentially as the machine travels along the face.

The means operated in accordance with the position of the mining or winning machine may provide a visual indication, for example with a needle or hand rotating about a scale, of the distance through which the machine has moved to thereby signify its position. The means can be basically in the form of a known form of odometer located generally remote from the machine e.g. at one end of the mine working, and adapted to provide control signals representing the position of the machine as it travels along the working. The means may employ electric contacts or the like which provide electric control signals which initiate opening of the appropriate control valves at the appropriate time to cause selected spray nozzles to discharge water to suppress dust in the zone over which the machine is actually working. The signals provided by the means, e.g. odometer, may indirectly actuate the control valves through the intermediary of further valves. In one constructional form the further valves are directly actuated by the signals from the means, e.g. odometer, and provide hydraulic signals for operating the main control valves. Conduits may thus connect the further valves to the main control valves.

As the machine commences its movement along the face it is desirable to spray water from groups of nozzles in such a way that except when the machine commences or ends its travel, water is sprayed from two adjacent groups of nozzles. To this end the control valves may have inputs connected to a water supply line and outputs connected to all the nozzles and to non-return valves whereby the nozzles are operationally divided into adjacent groups by the interaction of the control valves and the non-return valves. By way of example, some five to twenty groups of nozzles can be provided with a longwall working of 200–300 meters with each group comprise of say five to ten nozzles.

It is desirable to site the further valves in the vicinity of the means, e.g. odometer, and perhaps to form a constructional assembly therewith. The only parts of the apparatus then installed in the working would then be the control valves, their conduits or other control lines and the non-return valves together with the water supply. This ensures maximum protection. The control valves themselves may then be of simple robust design with no special devices for delaying their closure. A simple piston acted upon by pressure fluid passed through one of the further valves may provide the opening action for each control valve although electric control with or without the further valves is quite feasible.

The water sprayed by the nozzles can be ordinary water and if hydraulic fluid is used for operating the control valves the normal oil/water emulsion can be used as the fluid.

Apparatus made in accordance with the invention can be constructed in a particularly simple yet reliable manner and is most effective in ensuring efficient dust suppression in the zone over which the mineral winning machine is operating regardless of the speed of the latter.

The invention may be understood more readily, and various other features of the invention may become apparent from consideration of the following description.

BRIEF DESCRIPTION OF DRAWING

An embodiment of the invention will now be described, by way of example only, with reference to the accompanying drawing which is schematic plan view of a mineral mining installation employing apparatus made in accordance with the invention.

DESCRIPTION OF PREFERRED EMBODIMENT

As shown in the drawing a scraper-chain conveyor 11, which is capable of being shifted up to follow the mining progress, is arranged alongside a longwall mineral, e.g. coal, face 10. A mineral mining or winning machine 12 capable of detaching mineral from the face 10 is guided for movement back and forth along the conveyor 11 and the machine 12 can be in the form of a coal plough. Mineral detached from the face 10 by the machine 12 is loaded onto the conveyor 11 as the machine 12 progresses therealong. The material thus loaded onto the conveyor 11 is then transferred by the flights or scrapers thereof towards a delivery station 13 whereat the material is discharged onto a roadway conveyor 14. The roadway conveyor 14, which may also be a scraper-chain conveyor, extends along a roadway substantially perpendicular to the longwall working.

A measuring or indicating device 15, which also initiates a control function as described hereinafter, is provided for indicating the dynamic position of the machine 12 travelling along the conveyor 11. The device 15 which may be in the form of an odometer of known design, has an indicator 16, in this case a rotating hand, which sweeps over a circular scale in the manner of a clock face, signifying the prevailing path of travel of the machine 12 in increments, e.g. meters. Thus, at any instant the position of the indicator 16 represents the distance that the machine 12 has travelled from a reference datum, in this case one of the end zones of the conveyor 11 where the machine 12 starts or reverses its direction of movement.

In known manner spray nozzles 17 are distributed along the working on the stowage or goaf side of the conveyor 11. The nozzles 17 serve to spray water onto the machine 12, the conveyor 11 and the face 10 as the machine 12 moves in the general vicinity of the nozzles 17 in question. In this case the nozzles 17 are operably combined in groups I–V, with each group I–V being allocated to a certain portion of the length of the working. For convenience, the groups of nozzles II–V are merely represented in a schematic manner and each of these groups II–V generally corresponds to the group I shown in more detail. Each group I–V is composed of a plurality of nozzles 17, generally from five to ten nozzles 17, and all the nozzles 17 of the groups I–V are connected to a common water supply line 18.

The groups of nozzles I–V are also associated with control valves V1–V6 which serve to selectively connect the appropriate section of supply line 18 to a main supply line 19 to thereby cause the nozzles 17 thereof to spray water. Non-return valves 26 are incorporated in the line 18 to effectively isolate the desired groups I–V as described hereinafter. Each valve V1–V6 can have an inlet port connected to the line 19, an outlet port connected to the line 18 and a control input which serves to connect or disconnect the inlet and outlet ports in dependence on a separate control signal. In the present case, hydraulic control signals acting through the control inputs of the valves V1–V6 on a piston are utilized although pneumatic or electric signals are quite feasible. The control signals for the valves V1–V6 are conveyed via a number of control lines or conduits 20 laid along the working and connected to the respective control inputs of the valves V1–V6 via connection blocks 24 which are not however essential. The lines or conduits 20 are connected back to a control unit 21 which employs electro-magnetically operated valves M1–M6 united into a convenient assembly. Each valve M1–M6 is connected via one of the lines or conduits 20 to a respective one of the valves V1–V6. In the present case it is assumed that the signals for the valves V1–V6 are hydraulic and hence the control unit 21 is connected to a hydraulic pressure fluid supply 22 and when each valve M1–M6 is energized this supply 22 is connected via the valve M1–M6 to the associated conduit 20 and thence to the desired corresponding valve V1–V6.

The valves M1–M6 are adapted to be actuated by the device 15 and for this purpose control lines 23 link the device 15 to the valves M1–M6. The valves M1–M6 assembled into the control unit 21 may be further combined with the device 15 to form a single constructional unit therewith. The device 15 employs control means, such as electric contacts which are operated in accordance with the movement of the indicator 16 for instance in accordance with the movement of a rotary gearwheel coupled to the indicator 16. The control means, which can also be in the form of magnetic elements, can serve to provide electric signals to drive the valves M1–M6. The valves M1–M6 may be reset when an associated signal from the control means ceases or else definite on and off signals may be provided for each valve M1–M6. In any event as the indicator 16 moves around the scale the lines 23 carry signals which successively energize and de-energize the valves M1–M6 in indirect dependence on the movement of the machine 12. As each valve M1–M6 is energized, the appropriate valve V1–V6 causes the nozzles 17 of the associated groups I–V to spray water and when each valve M1–M6 is de-energized the flow of water from the nozzles 17 may cease. More particularly, and assuming that the machine 12 progresses from the left-hand side to the right-hand side of the drawing, the valve M1 is first energized to open the valve V1 and the nozzles 17 of the group I spray water. The non-return valve 26 connected to the valve V2 prevents the water in the line 18 and to the part of the line 18 linked to the nozzles 17 of group I from reaching the nozzles 17 of group II. When however the machine 12 has progressed to a position where the control means of the device 15 energizes the valve M2 so that the valve V2 opens, the outlet of the valve V2 feeds water to both the groups I,II via the non-return valves 26 connected thereto even although the valve V1 is now closed. During this phase of operations when the valve is opened the non-return valve 26 connected to the valve V3 and to the part of the line 18 linked to the nozzles 17 of the group II prevents water passing to the nozzles of group III. Thereafter as the machine 12 continues its travel, the next valve M3 operates to open the valve V3 and now the outlet of this valve V3 feeds water to both the groups II and III via the non-return valves 26 connected thereto. In this case however the presence of the valve 26 connected to the valve V2 and the part of the line 18 linked to the nozzles of group I and the presence of the valve 26 connected to the valve V4 and to the part of the line 18 linked to the nozzles of group III prevents water reaching the nozzles of groups I and IV. As can be appreciated this sequence continues with water spraying from adjacent groups I–V as the machine 12 progresses along the working. The same sequence of operations will occur in reverse when the machine 12 moves back from the right-hand side of the drawing to the left-hand side. Only when the valves V1 and V6 are operated signifying the machine 12 is at the end zone of its path will a single group of nozzles, in this case I and V, operate.

I claim:

1. In a mineral mining installation which employs a mineral winning machine moved along a mineral face and waterspray nozzles for spraying water in the operating region of the machine, apparatus for controlling the operation of the nozzles, said apparatus comprising a plurality of valves connected to the nozzles to cause water to be sprayed from a selected number of nozzles when actuated, and an electromechanical device separate from the machine for generating a series of control signals in accordance with the movement of the machine as it moves along the face, said signals serving to remotely actuate the valves.

2. Apparatus for controlling the operation of water-spray nozzles in a mineral mining installation which employs a mineral winning machine moved along a mineral face, said apparatus comprising a common device remotely separate from the machine and its path of movement, said device being operated in accordance with the movement of the machine as it travels along the face to produce distance-indicative signals as well as a visual indication of the position of the machine, and a plurality of control valves adapted to be actuated remotely by said signals to cause selected spray nozzles to operate sequentially as the machine travels along the face.

3. An apparatus according to claim 1, wherein said device is in the form of an odometer, the primary function of which is to provide a visual indication of the position of the machine and wherein the control signals therefrom indirectly cause the valves to open or close.

4. An apparatus according to claim 3, wherein there are provided further valves actuated by the signals from said means and adapted to provide corresponding further signals for actuating the first-mentioned valves.

5. An apparatus according to claim 4, wherein the further signals are hydraulic signals.

6. Apparatus according to claim 4, wherein the signals provided by said device are electric signals.

7. Apparatus according to claim 1, wherein the valves have inputs connected to a water supply line and outputs connected to all the nozzles and to non-return valves whereby the nozzles are operationally divided into adjacent groups by the interaction of the control valves and the non-return valves.

8. Apparatus according to claim 7, wherein further valves are operated by said device and in turn operate the first-mentioned valves by means of pressure fluid conveyed to the first-mentioned valves by way of conduits.

9. Apparatus for controlling the operation of water-spray nozzles in a mineral mining installation which employs a mineral winning machine moved along a mineral face, said apparatus comprising an odometer separate from the machine and its path of movement and operated in accordance with the position of the machine as it travels along the face to provide a series of electric signals directly related to the distance moved by the machine, and a plurality of control valves actuated remotely by said signals to cause selected spray nozzles to operate sequentially as the machine travels along the face.

* * * * *